US009542891B2

(12) United States Patent
Park et al.

(10) Patent No.: US 9,542,891 B2
(45) Date of Patent: Jan. 10, 2017

(54) ORGANIC ELECTROLUMINESCENCE DISPLAY AND DRIVING METHOD THEREOF

(71) Applicant: LG DISPLAY CO., LTD., Seoul (KR)

(72) Inventors: Dongwon Park, Goyang-si (KR); Sunghoon Kim, Paju-si (KR); Younghwan Ahn, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 3 days.

(21) Appl. No.: 14/583,503

(22) Filed: Dec. 26, 2014

(65) Prior Publication Data

US 2015/0187280 A1 Jul. 2, 2015

(30) Foreign Application Priority Data

Dec. 27, 2013 (KR) ..... 10-2013-0166166

(51) Int. Cl.
*G09G 3/3291* (2016.01)
*G09G 3/32* (2016.01)
*G09G 3/20* (2006.01)

(52) U.S. Cl.
CPC ..... *G09G 3/3291* (2013.01); *G09G 3/2022* (2013.01); *G09G 2310/027* (2013.01); *G09G 2310/061* (2013.01); *G09G 2320/0673* (2013.01)

(58) Field of Classification Search
CPC ..... G09G 3/3233; G09G 2300/0819; G09G 2300/0866; G09G 2300/0842
See application file for complete search history.

(56) References Cited

U.S. PATENT DOCUMENTS

2003/0111964 A1 6/2003 Childs
2006/0077138 A1* 4/2006 Kim ..... G09G 3/3233 345/76
2006/0208973 A1* 9/2006 Lee ..... G09G 3/3233 345/76
2006/0232600 A1* 10/2006 Kimura ..... G09G 3/32 345/605

FOREIGN PATENT DOCUMENTS

CN 1605092 A 4/2005
CN 1912978 A 2/2007
CN 101086820 A 12/2007

OTHER PUBLICATIONS

Office Action dated May 27, 2015 for corresponding British Application No. GB1421601.4, 6 pages.
Office Action dated Sep. 5, 2016 for Chinese Application No. 201410822305.0, 18 pages.

* cited by examiner

*Primary Examiner* — Andrew Sasinowski
*Assistant Examiner* — Chun-Nan Lin
(74) *Attorney, Agent, or Firm* — Brinks Gilson & Lione

(57) ABSTRACT

An organic electroluminescence display that drives a display panel by a digital driving scheme. The organic electroluminescence display includes: a data driver that supplies a data signal in units of subframes to the display panel; and a power supply that supplies a high-potential voltage to the display panel, wherein the power supply that varies the high-potential voltage supplied to subpixels of the display panel for each subframe.

8 Claims, 13 Drawing Sheets

$$SF1 \doteqdot SF2 \doteqdot SF3 \doteqdot SF4$$

SF1 < SF2 < SF3 < SF4

V1 < V2 < V3 < V4

ORGANIC ELECTROLUMINESCENCE DISPLAY AND DRIVING METHOD THEREOF

This application claims the benefit of priority to Korea Patent Application No. 10-2013-0166166 filed on Dec. 27, 2013, which is incorporated herein by reference for all purposes as if fully set forth herein.

BACKGROUND

Field

This document relates to an organic electroluminescence display and a driving method thereof.

Related Art

An organic electroluminescence element used for an organic electroluminescence display is a self-luminous element including a light emission layer formed between two electrodes. The organic electroluminescence element is an element in which electrons and holes are injected into the light emission layer from an electron injection electrode (e.g., cathode) and a hole injection electrode (e.g., anode). As excitons formed as the injected electrons and holes are combined fall from the excited state to the ground state, light is emitted.

In the organic electroluminescence display, when a scan signal, a data signal, power, and the like, are supplied to a plurality of subpixels disposed in a matrix, selected subpixels emit light to display an image.

Driving schemes of the organic electroluminescence display are divided into an analog driving scheme for driving the organic electroluminescence device by supplying current or voltage to a display panel and a digital driving scheme for adjusting light emission time. The digital driving scheme includes an ADS (Address Display Separation) driving scheme and an AWD (Address While Display) driving scheme.

In a conventional ADS driving scheme, subframes and addressing time are limited by the frame rate and resolution of a display device, and are under many time constraints because multiple frames are required to achieve sufficient color depth. In a conventional AWD driving scheme, each subframe includes an erasing period for erasing a data signal if required. In this case, the duty cycle (ratio of on time to total light emission time) decreases by an amount equal to the erasing period.

As a consequence, the conventional ADS and AWD driving schemes face numerous difficulties in realizing a large-area, high-resolution display panel due to the aforementioned problems, and thus these problems must be overcome.

SUMMARY

An aspect of this document is to provide an organic electroluminescence display comprises: a data driver that supplies a data signal in units of subframes to the display panel; and a power supply that supplies a high-potential voltage to the display panel, wherein the power supply varies the high-potential voltage supplied to subpixels of the display panel for each subframe.

In another aspect, a driving method of an organic electroluminescence display that drives a display panel by a digital driving scheme, comprises: supplying a data signal in units of subframes to the display panel; and supplying a high-potential voltage to the display panel and varying the high-potential supplied to subpixles of the display panel for each subframe.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail embodiments of the invention, examples of which are illustrated in the accompanying drawings.

Hereinafter, a concrete exemplary embodiment will be described with reference to the accompanying drawings.

An organic electroluminescence display to be described below is implemented by a digital driving scheme for adjusting light emission time. The digital driving scheme includes an ADS (Address Display Separation) driving scheme and an AWD (Address While Display) driving scheme. The ADS driving scheme is a method in which addressing time and light emission time are separated, and the AWD driving scheme is a method in which addressing time and light emission time partially overlap each other.

In a conventional ADS driving scheme, subframes and addressing time are limited by the frame rate and resolution of a display device, and are under numerous time constraints because multiple frames are required to achieve sufficient color depth. In a conventional AWD driving scheme, each subframe includes an erasing period for erasing a data signal if required. In this case, the duty cycle (ratio of on time to total light emission time) decreases by an amount equal to the erasing period.

Therefore, the conventional ADS and AWD driving schemes face numerous difficulties in realizing a large-area, high-resolution display panel due to the aforementioned problems, and these problems must be overcome.

Figure 1:
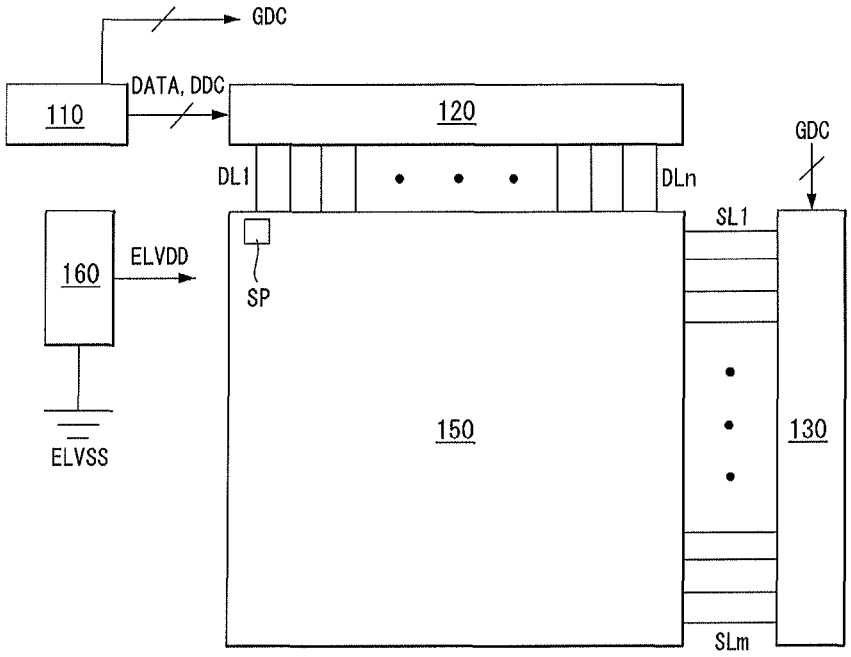
FIG. 1 is a schematic block diagram of an organic electroluminescence display according to a first exemplary embodiment of the present invention.
Figure 2:
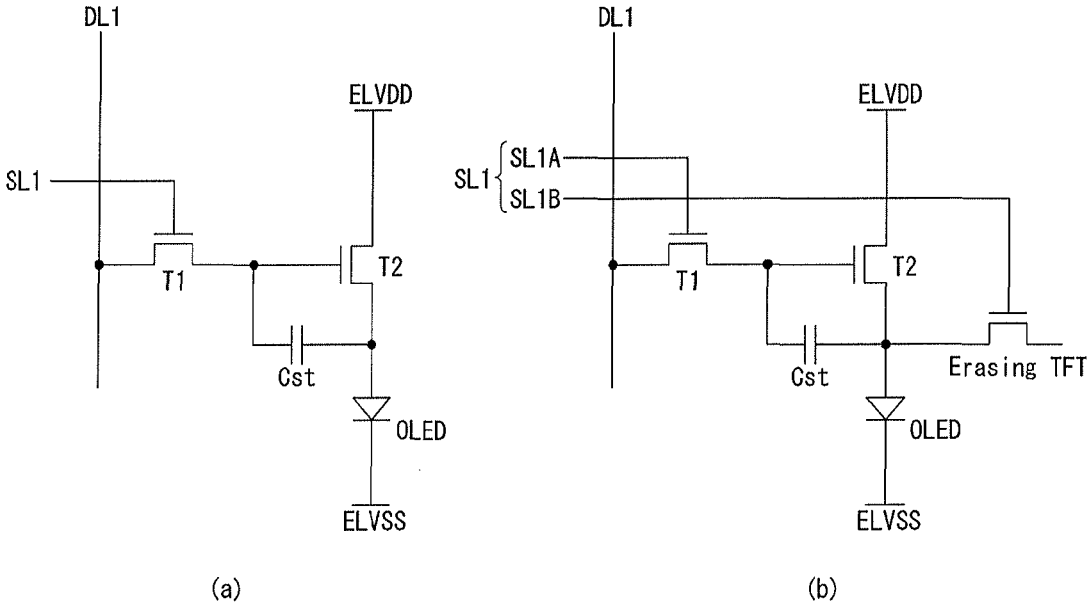
FIG. 2 is a circuit diagram of a subpixel according to the first exemplary embodiment.

FIG. 1 is a schematic block diagram of an organic electroluminescence display according to a first exemplary embodiment. FIG. 2 is a circuit diagram of a subpixel according to the first exemplary embodiment.

As shown in FIG. 1, the organic electroluminescence display according to the first exemplary embodiment comprises a timing controller 110, a data driver 120, a scan driver 130, a power supply 160, and a display panel 150.

The timing controller 110 collects extended display identification data (EDID) or compensation data from an external memory through an I2C interface. The timing controller 110 outputs a data timing control signal DDC for controlling operation timing of the data driver 120 and a gate timing control signal GDC for controlling operation timing of the scan driver 130. The timing controller 110 supplies the data signal DATA, along with the data timing control signal DDC, to the data driver 140.

The data driver 120 samples and latches the data signal DATA in response to the data timing control signal DDC received from the timing controller 110, and converts and outputs it based on a gamma reference voltage. The data driver 120 may be formed in the form of an integrated circuit IC and mounted on the display panel 150 or on an external substrate connected to the display panel 150. The data driver 120 supplies the data signal DATA through data lines DL1 to DLn connected to subpixels SP of the display panel 150.

The scan driver 130 shifts the level of a gate voltage in response to the gate timing control signal GDC received from the timing controller 110 and outputs a scan signal. The scan driver 130 may be formed as an integrated circuit IC and mounted on the display panel 150 or on an external substrate connected to the display panel 150. Also, the scan driver 130 may be formed as a gate-in-panel in a non-display area of the display panel 150. The scan driver 130 supplies a scan signal through scan lines SL1 to SLm connected to the subpixels SP of the display panel 150.

The power supply 160 outputs a high-potential voltage and a low-potential voltage based on externally supplied power. The high-potential voltage output from the power supply 160 is transmitted to the subpixels SP of the display panel 150 through a common ground line ELVSS.

The display panel 150 displays an image in response to the scan signal supplied from the scan driver 130 and the data signal DATA supplied from the data driver 120. The display panel 150 comprises the subpixels SP that control light to display an image. The display panel 150 is implemented as a top-emission type, a bottom-emission type, or a dual emission type according to the structure of the subpixels SP.

As shown in (a) of FIG. 2, a subpixel SP comprises a first transistor T1, a second transistor T2, a capacitor Cst, and an organic light emitting diode OLED.

The first transistor T1 has a gate electrode connected to a first scan line SL1, a first electrode connected to a first data line DL1, and a second electrode connected to the gate electrode of the second transistor T2. The first transistor T1 serves to transmit a data signal to the capacitor Cst in response to a scan signal.

The second transistor T2 has a gate electrode connected to the second electrode of the first transistor T1, a first electrode connected to a first power line ELVDD, a second electrode connected to the anode of the organic light emitting diode. The second transistor T2 serves to drive the organic light emitting diode OLED in response to a data voltage stored in the capacitor Cst.

The capacitor Cst has one end connected to the second electrode of the first transistor T1 and the gate electrode of the second transistor T2 and the other end connected to the second electrode of the second transistor T2 and the anode of the light emitting diode OLED. The capacitor Cst serves to store a data voltage and transmit the stored data voltage to the second transistor T2.

The organic light emitting diode OLED has the anode connected to the second electrode of the second transistor T2 and the other end of the capacitor Cst and a cathode connected to a ground line ELVSS.

As shown in (b) of FIG. 2, a subpixel SP comprises a first transistor T1, a second transistor T2, a capacitor Cst, an organic light emitting diode OLED, and an erasing TFT.

The first transistor T1 has a gate electrode connected to a 1A scan line SL1A, a first electrode connected to a first data line DL1, and a second electrode connected to the gate electrode of the second transistor T2. The first transistor T1 serves to transmit a data signal to the capacitor Cst in response to a scan signal.

The second transistor T2 has the gate electrode connected to the second electrode of the first transistor T1, a first electrode connected to a first power line ELVDD, and a second electrode connected to the anode of the organic light emitting diode OLED. The second transistor T2 serves to drive the organic light emitting diode OLED in response to a data voltage stored in the capacitor Cst.

The capacitor Cst has one end connected to the second electrode of the first transistor T1 and the gate electrode of the second transistor T2 and the other end connected to the second electrode of the second transistor T2 and the anode of the light emitting diode OLED. The capacitor Cst serves to store a data voltage and transmit the stored data voltage to the second transistor T2.

The organic light emitting diode OLED has the anode connected to the second electrode of the second transistor T2 and the other end of the capacitor Cst and a cathode connected to a ground line ELVSS.

The erasing TFT has a gate electrode connected to a 1B scan line SL1B, a first electrode connected to the second electrode of the second transistor and the other end of the capacitor Cst, and a second electrode connected to a signal line that supplies an erasing signal. The erasing TFT serves to erase a previously supplied data signal. In the foregoing explanation, the first electrode and the second electrode may be defined as a source electrode and a drain electrode or vice versa depending on the relation of connection.

The subpixel with no erasing TFT as shown in (a) of FIG. 2 can be used when the resolution of the display panel is low.

On the other hand, the subpixel comprising an erasing TFT as shown in (b) of FIG. 2 can be used when the resolution of the display panel is high.

The organic electroluminescence display according to the first exemplary embodiment may be implemented by an AWD driving scheme. In the AWD driving scheme, the organic light emitting diode emits light while performing an addressing operation to supply a data signal. In the following description, the conventional art and the first exemplary embodiment will be compared to help understanding of the present disclosure. For convenience of explanation, first to fourth subframes are shown, but this is only an example and n (N is a positive integer greater than 4) subframes may be provided.

Figure 3:
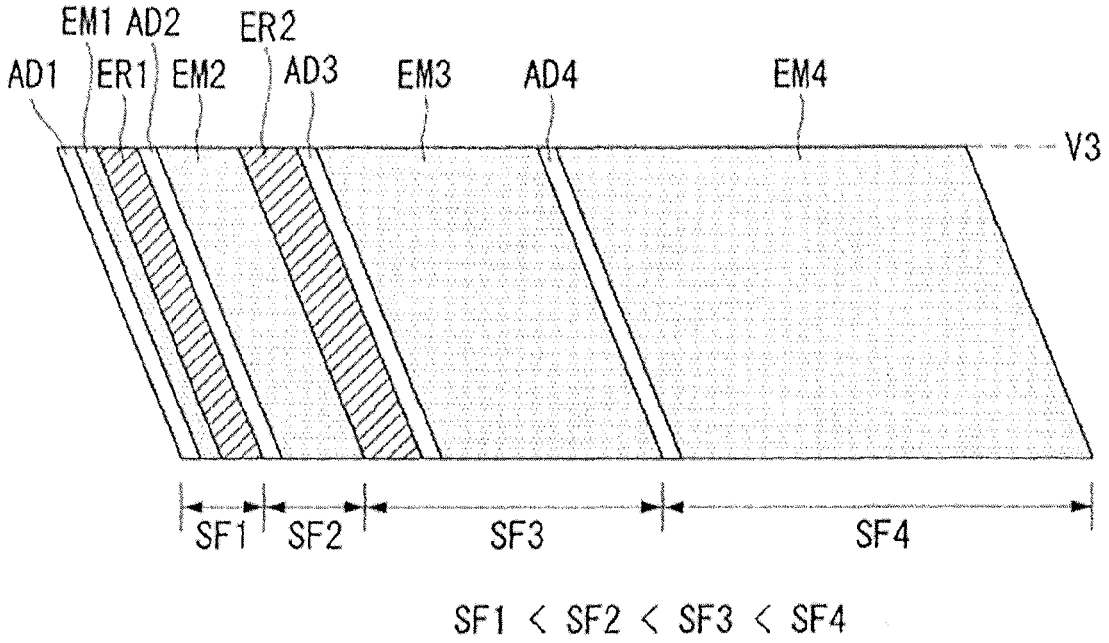
FIG. 3 is a view showing a conventional AWD digital driving scheme.
Figure 4:
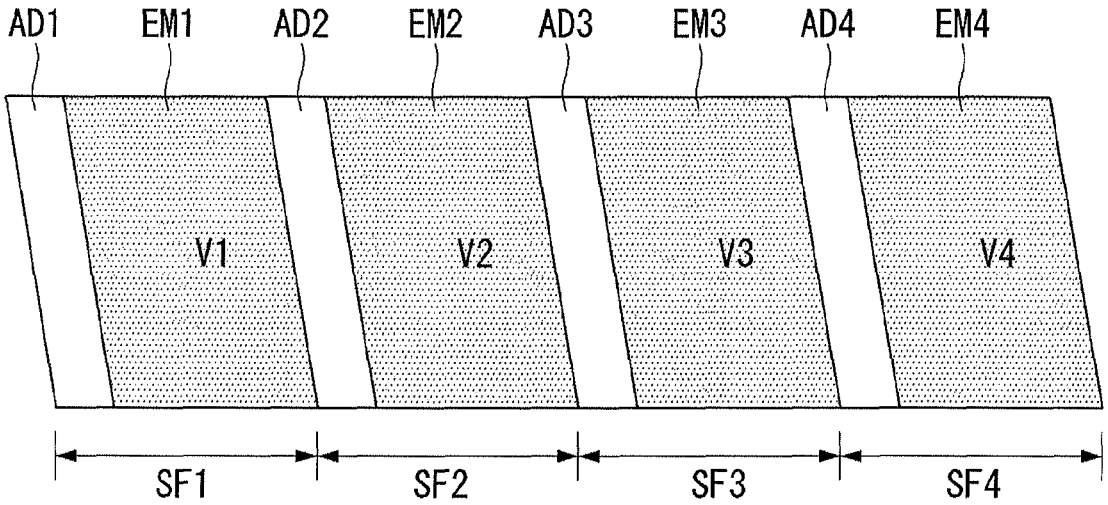
FIG. 4 is a view showing an AWD digital driving scheme according to the first exemplary embodiment of the present invention.
Figure 5:
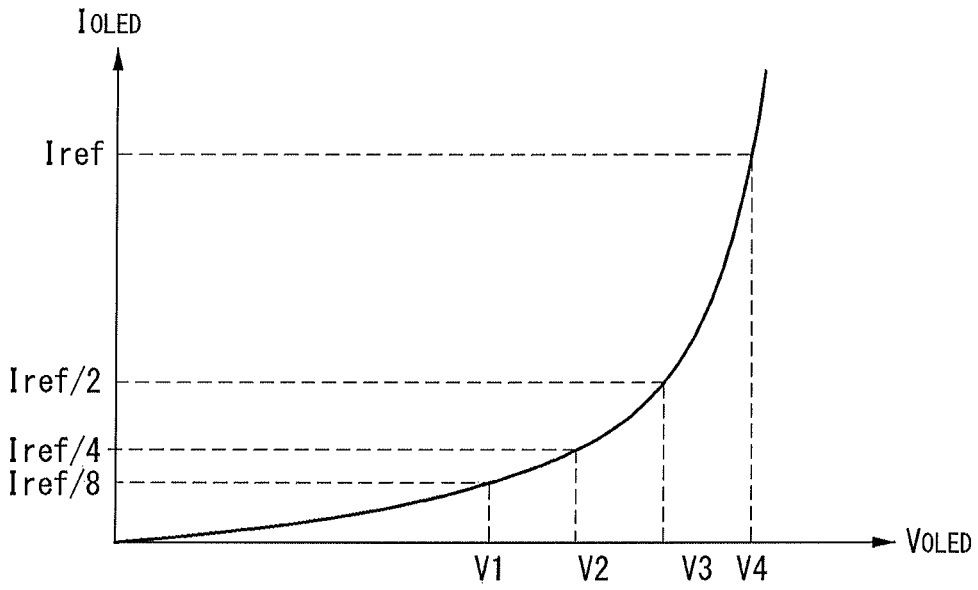
FIGS. 5 and 6 are views for explaining the concept of the AWD digital driving scheme according to the first exemplary embodiment of the present invention.
Figure 6:
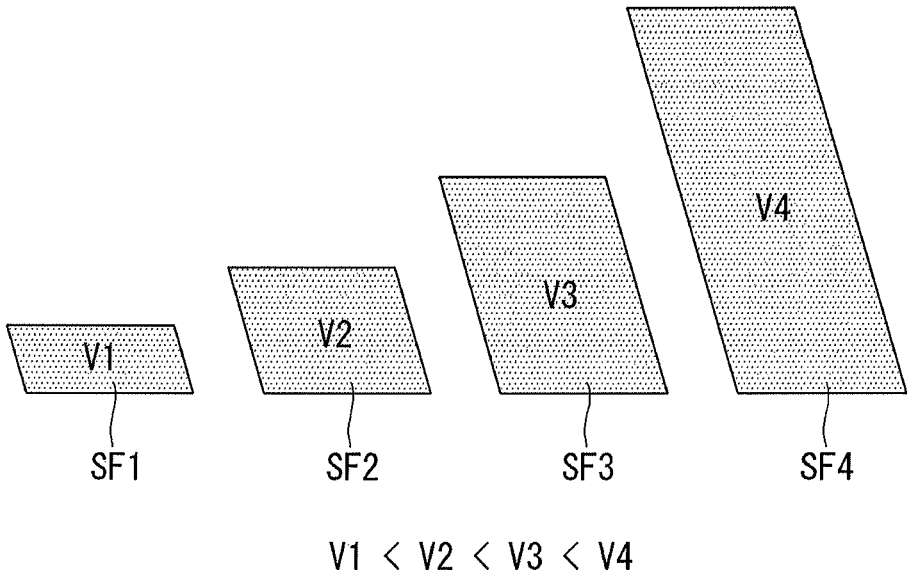

FIG. 3 is a view showing a conventional AWD digital driving scheme. FIG. 4 is a view showing an AWD digital driving scheme according to the first exemplary embodiment. FIGS. 5 and 6 are views for explaining the concept of the AWD digital driving scheme according to the first exemplary embodiment.

Conventional AWD Digital Driving Scheme

As shown in FIG. 3, the conventional AWD digital driving scheme comprises addressing periods AD1 to AD4 for supplying a data signal, light emission periods EM1 to EM4 for causing the organic light emitting diode to emit light, and erasing periods ER1 and ER2 for erasing a previously supplied data signal.

In the conventional AWD digital driving scheme, the proportions of the light emission periods EM1 to EM4 of first to fourth subframes SF1 to SF4 are different. Specifically, the proportions of the light emission periods EM1 to EM4 of first to fourth subframes SF1 to SF4 are in the order of SF<SF2<SF3<SF4. The first to fourth subframes SF1 to SF4 show equal luminance. The conventional AWD digital driving scheme operates in this manner because gradation is determined by the proportions of the light emission periods of subframes.

As can be known from the light emission periods EM1 and EM2 of the first and second subframes SF1 and SF2, the conventional digital driving scheme requires the erasing periods ER1 and ER2 for erasing any data signal supplied in the subframes SF1 and SF2 with low gray vales. The conventional AWD digital driving scheme operates in this manner the addressing period of the next subframe must be secured.

As described above, in the conventional AWD driving scheme, each subframe includes an erasing period for erasing a data signal if required. In this case, the duty cycle (ratio of on time to total light emission time) decreases by an amount equal to the erasing period.

AWD Digital Driving Scheme According to First Exemplary Embodiment

As shown in FIG. 4, the AWD digital driving scheme according to the first exemplary embodiment comprises addressing periods AD1 to AD4 for supplying a data signal and light emission periods EM1 to EM4 for causing the organic light emitting diode to emit light.

In the AWD digital driving scheme according to the first exemplary embodiment, the proportions of the light emission periods EM1 to EM4 of first to fourth subframes SF1 to SF4 are similar or equal. Specifically, the proportions of the light emission periods EM1 to EM4 of first to fourth subframes SF1 to SF4 are in the order of SF≈SF2≈SF3≈SF4. The first to fourth subframes SF1 to SF4 show different luminance.

In the AWD digital driving scheme according to the first exemplary embodiment, a high-potential voltage supplied to the subpixels of the display panel for each subframe is varied in order to reduce temporal load on subframes.

For example, in order to increase the light emission period of a subframe with a low gray level (or a low-order bit subframe), the amount of current to the subpixels can be reduced by lowering the high-potential voltage, or the amount of light emission can be decreased by adjusting the light emission period and non-light emission period (on/off) of the subpixels. Also, in order to decrease the light emission period of a subframe with a high gray level (or a high-order bit subframe), the amount of current flowing through the subpixels can be increased by raising the high-potential voltage, or the amount of light emission can be increased by adjusting the light emission period and non-light emission period (on/off) of the subpixels.

To equalize the light emission periods of subframes (make the integral of luminance equal) as in the AWD, digital driving scheme according to the first exemplary embodiment, current and voltage must be set to be in proportion to each other.

As depicted in the curve of current flowing through the organic light emitting diode versus voltage in FIG. 5, the high-potential voltage supplied to the subpixels has to vary for each subframe with reference to the voltage VOLED that determines the current IOLED proportional to luminance. For example, the high-potential voltage should vary from first to fourth voltages V1 to V4 to show the luminance corresponding to first to fourth currents Iref/8 to Iref. As the current IOLED is in the relationship: Iref/8<Iref/4<Iref/2<Iref, the voltage VOLED is in the relationship: V1<V2<V3<V4 as shown in FIG. 6.

Due to this, the high-potential voltage is fixed for all subframes, as shown in V3 of FIG. 3, in the conventional AWD driving scheme, whereas the high-potential voltage varies for each subframe, as shown in V1 to V4 of FIG. 4, in the AWD digital driving scheme according to the first exemplary embodiment.

By equalizing the light emission periods of subframes under the above-mentioned condition, erasing periods necessarily used in the conventional AWD driving scheme can be omitted depending on the resolution of the display panel. Therefore, the conventional AWD driving scheme according to the first exemplary embodiment can omit erasing periods for erasing a previously supplied data signal, thereby solving the problem of decreased duty cycle (ratio of on time to total light emission time).

Second Exemplary Embodiment

Figure 7:
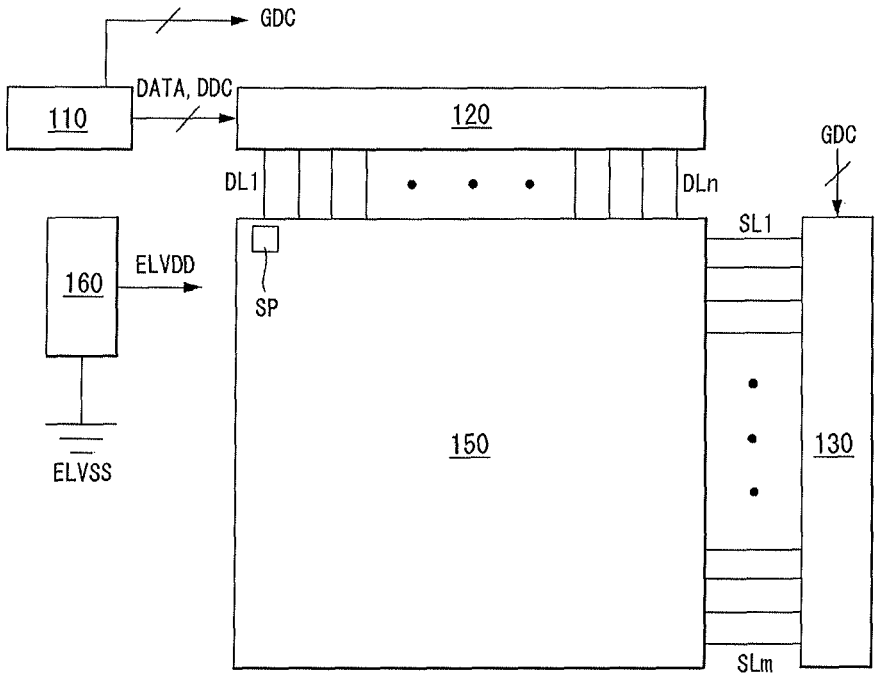
FIG. 7 is a schematic block diagram of an organic electroluminescence display according to a second exemplary embodiment of the present invention.
Figure 8:
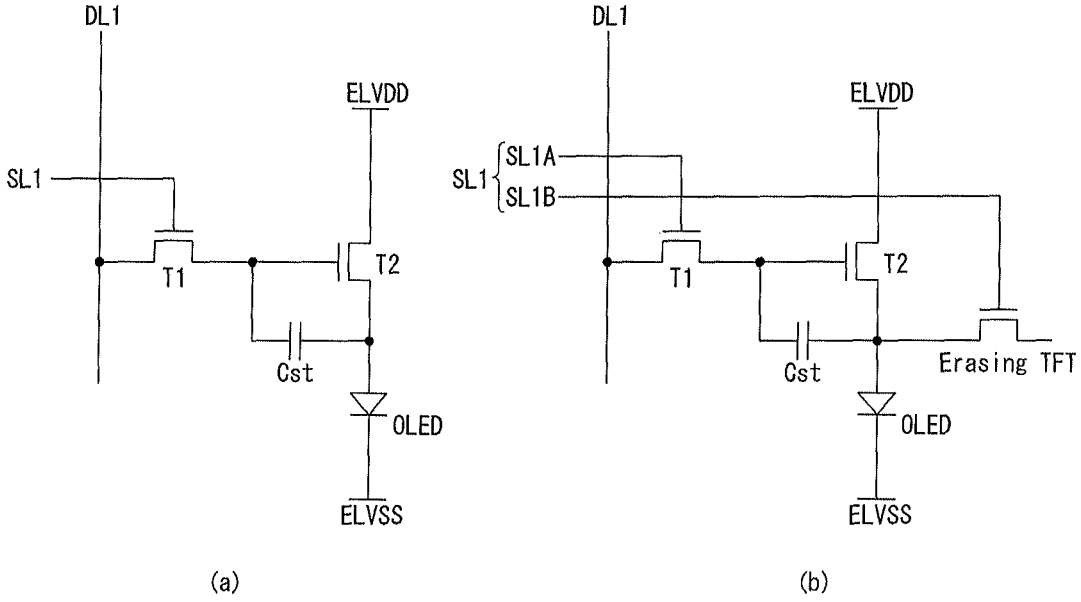
FIG. 8 is a circuit diagram of a subpixel according to the second exemplary embodiment of the present invention.

FIG. 7 is a schematic block diagram of an organic electroluminescence display according to a second exemplary embodiment. FIG. 8 is a circuit diagram of a subpixel according to the second exemplary embodiment.

As shown in FIG. 7, the organic electroluminescence display according to the second exemplary embodiment comprises a timing controller 110, a data driver 120, a scan driver 130, a power supply 160, and a display panel 150.

As shown in (a) of FIG. 8, a subpixel SP comprises a first transistor T1, a second transistor T2, a capacitor Cst, and an organic light emitting diode OLED, and as shown in (b) of FIG. 8, further comprises an erasing TFT.

The timing controller 110, the data driver 120, the scan driver 130, the power supply 160, the display panel 150, and the subpixel SP have been described in the first exemplary embodiment, so the descriptions of them will be omitted to avoid redundancy.

The organic electroluminescence display according to the second exemplary embodiment is implemented by an AWD driving scheme. Particularly, the organic electroluminescence display according to the second exemplary embodiment can be used to solve the problems that may occur when varying a high-potential voltage to equalize the light emission periods of subframes, like the AWD driving scheme according to the first exemplary embodiment. In the following description, a test example and the second exemplary embodiment will be compared to help understanding of the present disclosure.

Figure 9:
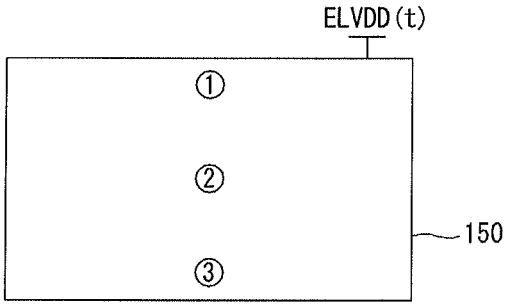
FIGS. 9 to 11 are views showing an AWD digital driving scheme according to a test example.
Figure 10:
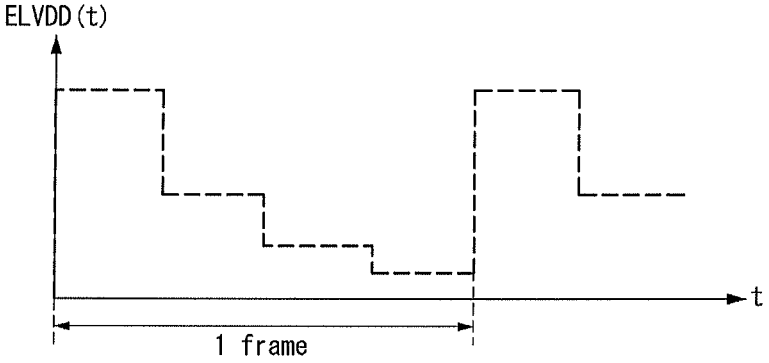
Figure 11:
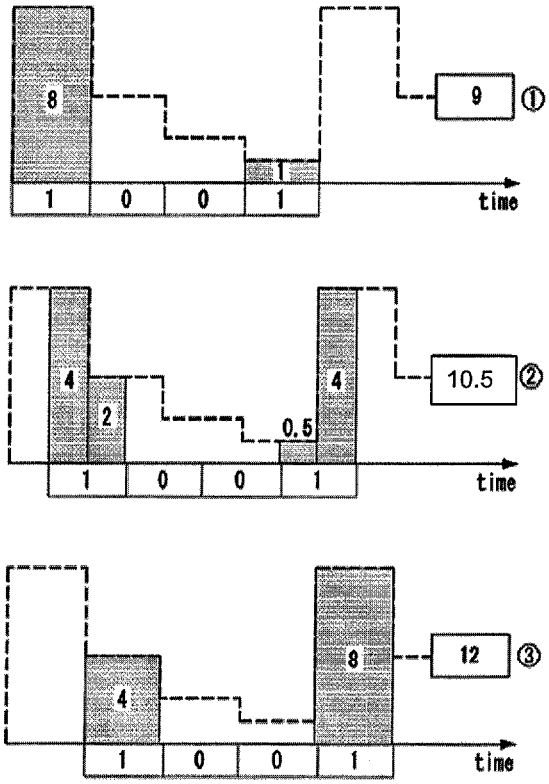
Figure 12:
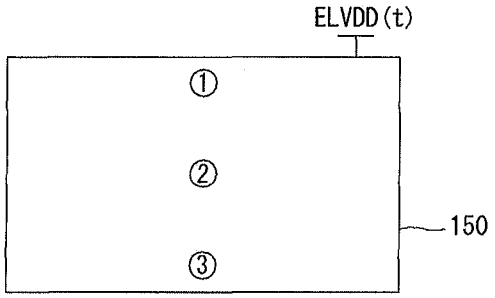
FIGS. 12 and 13 are views for explaining the concept of the AWD digital driving scheme according to the second exemplary embodiment.
Figure 13:
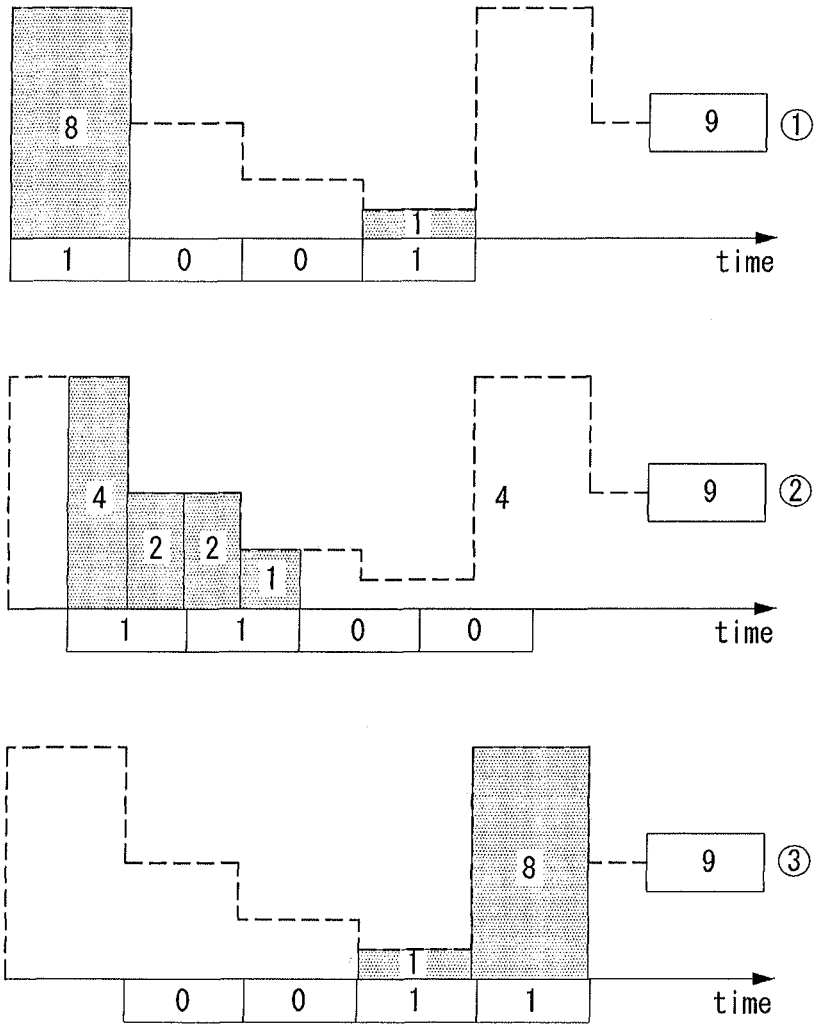

FIGS. 9 to 11 are views showing an AWD digital driving scheme according to a test example. FIGS. 12 and 13 are views for explaining the concept of the AWD digital driving scheme according to the second exemplary embodiment.

AWD Digital Driving Scheme According to Test Example

As shown in FIG. 9, in the AWD digital driving scheme according to the test example, a first power line ELVDD is commonly connected to all subpixels included in the display panel 150. A high-potential voltage supplied through the first power line ELVDD is transmitted first to a first display area 1 of the display panel 150 and then to a second display area 2 and a third display area 3.

As shown in FIG. 10, a high-potential voltage, varying between different levels during 1 frame, was supplied to the display panel 150 through the first power line ELVDD (refer to the first exemplary embodiment of the present invention for the method of supplying a high-potential voltage varying between different levels during 1 frame). However, luminance differences were generated as shown in FIG. 1.

Referring to FIG. 11, a result of supplying a subframe with a bit value of 1001 commonly to the first to third display areas 1 to 3 will be described in detail below.

The first display area 1 received the subframe with the bit value of 1001 and showed a luminance of 9. On the other hand, the second display area 2 received the subframe with the bit value of 1001 and showed a luminance of 10.5, and the third display area 3 received the subframe with the bit value of 1001 and showed a luminance of 12.

The high-potential voltage supplied through the first power line ELVDD varies for all positions on the display panel 140. However, the light emission starting time of subpixels differs depending on where each line is located. For example, even if the subpixels receive a subframe with the same bit value of 1001, the high-potential voltage varies with position during 1 frame with respect to an on/off data signal for the subpixels, thus generating luminance differences.

AWD Digital Driving Scheme According to Second Exemplary Embodiment

As shown in FIG. 12, in the AWD digital driving scheme according to the second exemplary embodiment, a first power line ELVDD is commonly connected to all subpixels included in the display panel 150. A high-potential voltage supplied through the first power line ELVDD starts from a first display area 1 of the display panel 150 and is then transmitted to a second display area 2 and a third display area 3.

As shown in FIG. 10, a high-potential voltage, varying between different levels during 1 frame, was supplied to the display panel 150 through the first power line ELVDD, and as shown in FIG. 13, the bit value of a subframe was corrected for each position on the display panel 150. However, luminance differences were generated as shown in FIG. 1.

Referring to FIG. 13, the method of correction for different positions like the first to third display areas 1, 2, and 3 will be described in detail below.

The first display area 1 received the subframe with the bit value of 1001 and showed a luminance of 9.

The second display area 2 corresponding to the middle part of the display panel 150 received a subframe with a bit value of 1100 and showed the luminance of 9.

The third display area 3 received a subframe with the bit value of 0011 and showed the luminance of 9.

As explained above, the problem of luminance differences can be solved by correcting the bit value of a subframe for each position on the display panel 150 when supplying a high-potential voltage, varying between different levels during 1 frame, commonly to the display panel 150. In other words, luminance differences within the same subframe can be compensated for by varying the bit value of the subframe for each position on the display panel 150.

Third Exemplary Embodiment

Figure 14:
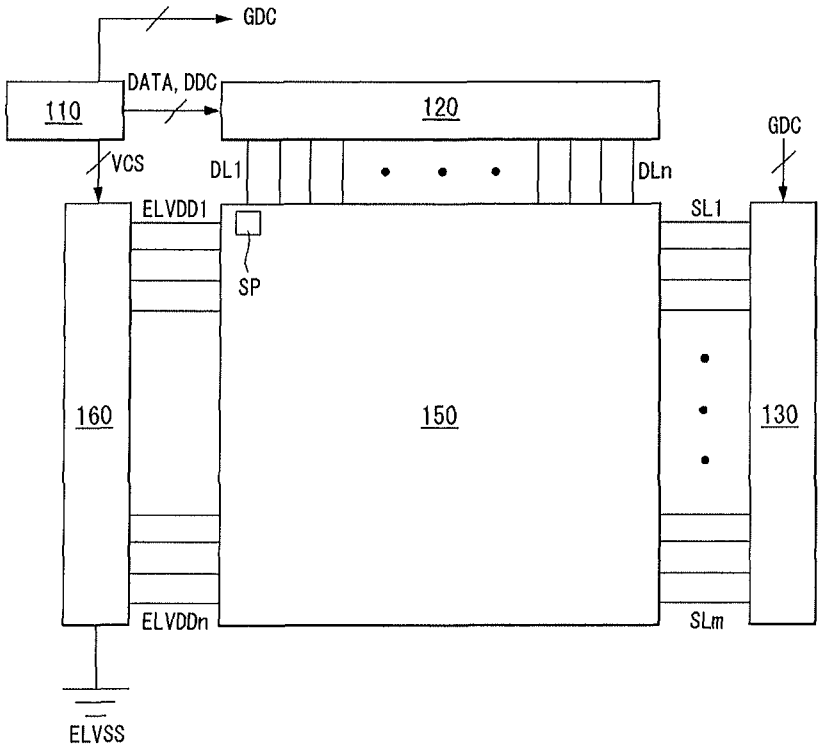
FIG. 14 is a schematic block diagram of an organic electroluminescence display according to a third exemplary embodiment.
Figure 15:
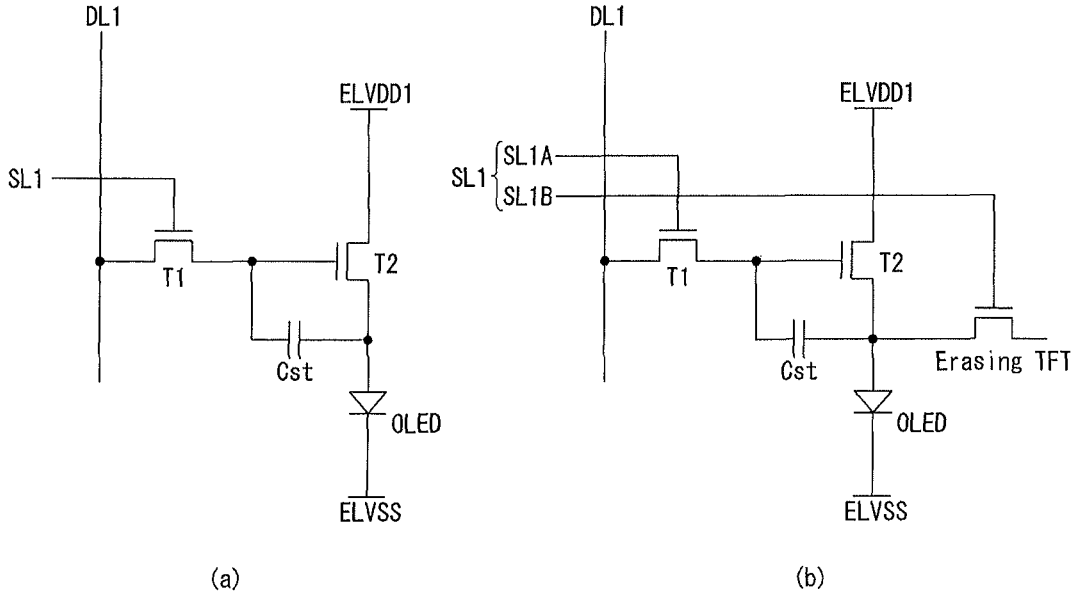
FIG. 15 is a circuit diagram of a subpixel according to the third exemplary embodiment.

FIG. 14 is a schematic block diagram of an organic electroluminescence display according to a third exemplary embodiment. FIG. 15 is a circuit diagram of a subpixel according to the third exemplary embodiment.

As shown in FIG. 14, the organic electroluminescence display according to the third exemplary embodiment comprises a timing controller 110, a data driver 120, a scan driver 130, a power supply 160, and a display panel 150.

The power supply 160 outputs first to nth high-potential voltages and a low-potential voltage based on externally supplied power. The first to nth high-potential voltages vary for each subframe. The first to nth high-potential voltages output from the power supply 160 are respectively transmitted through first to nth power lines ELVDD1 to ELVDDn that are separated horizontally (or along a scan line direction) or vertically (or along a data line direction) with respect to the subpixels SP of the display panel 150.

For instance, the power supply 160 may output first to nth high-potential voltages whose phase changes every n power lines ELVDD1 to ELVDDn, in response to a voltage control signal VCS output from the timing controller 110. In contrast, the low-potential voltage output from the power supply 160 is transmitted to the subpixels SP of the display panel 150 through a common ground line ELVSS.

As shown in (a) of FIG. 15, a subpixel SP comprises a first transistor T1, a second transistor T2, a capacitor Cst, and an organic light emitting diode OLED, and as shown in (b) of FIG. 15, further comprises an erasing TFT.

The timing controller 110, the data driver 120, the scan driver 130, the power supply 160, the display panel 150, and the subpixel SP have been described in the first exemplary embodiment, so the descriptions of them will be omitted to avoid redundancy.

The organic electroluminescence display according to the third exemplary embodiment is implemented by an AWD driving scheme. Particularly, the organic electroluminescence display according to the third exemplary embodiment can be used to solve the problems that may occur when varying a high-potential voltage to equalize the light emission periods of subframes, like the AWD driving scheme according to the first or second exemplary embodiment.

The following description will be made by taking an example where the first to nth power lines ELVDD1 to ELVDDn connected to the subpixels of the display panel 150 are separated horizontally (or along the scan line direction).

Figure 16:
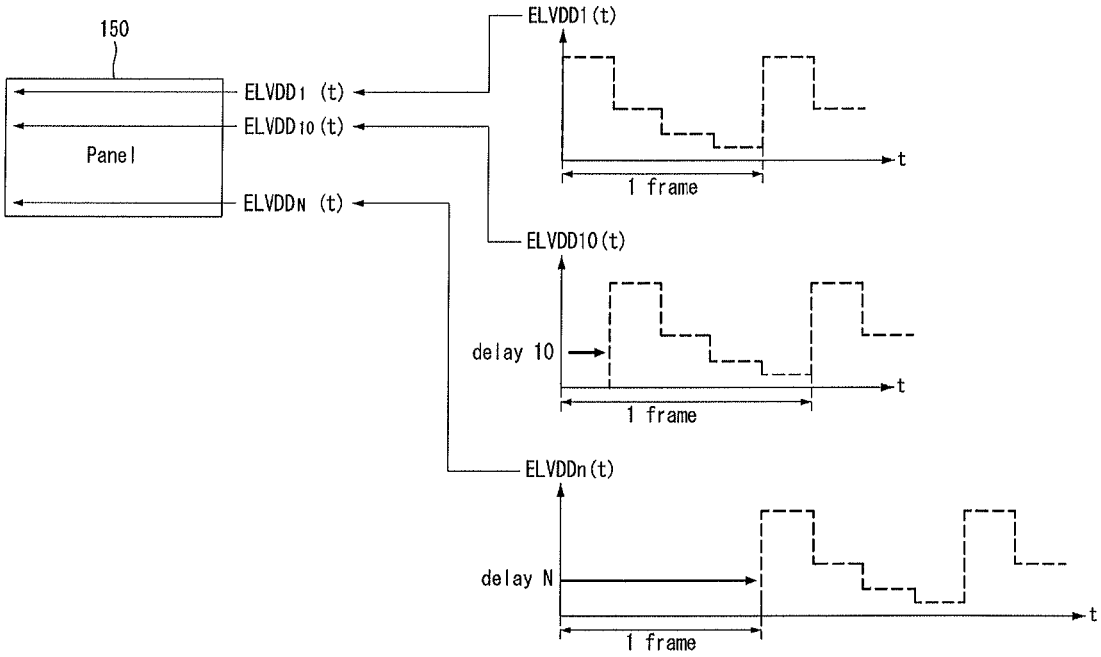
FIG. 16 is a view for explaining the concept of the AWD digital driving scheme according to the third exemplary embodiment.

FIG. 16 is a view for explaining the concept of the AWD digital driving scheme according to the third exemplary embodiment.

As shown in FIG. 16, the first to nth power lines ELVDD1 to ELVDDn connected to the subpixels SP of the display panel 150 are separated horizontally (or along the scan line direction).

The first power line ELVDD1 transmits the first high-potential voltage that varies for each subframe during 1 frame. The 10th power line ELVDD10 transmits the 10th high-potential voltage that varies for each subframe during 1 frame. The nth power line ELVDDn transmits the nth high-potential voltage that varies for each subframe during 1 frame.

The first to nth power lines ELVDD1 to ELVDDn are separated for different scan lines, and the first to nth high-potential voltages to be transmitted through the first to nth power lines ELVDD1 to ELVDDn are output at different times for different lines in response to a scan signal.

Due to this, the 10th high-potential voltage is transmitted to the 10th power line ELVDD10 after a 10th delay (e.g., delay 10) with respect to the first high-potential voltage, and the nth high-potential voltage is transmitted to the nth power line ELVDDn after an nth delay (e.g., delay N) with respect to the first high-potential voltage. Accordingly, the first to nth high-potential voltages vary for each subframe, and their phase changes every scan line.

In comparison with the third exemplary embodiment, the second exemplary embodiment can solve the problem of luminance differences by correcting the bit value of a subframe for each position on the display panel 150 because the display areas of the display panel 150 have physically different IR drop characteristics.

In the third exemplary embodiment, on the other hand, power lines are separated for different scan lines, like the first to nth power lines ELVDD1 to ELVDDn are, in accordance with physically difference IR drop characteristics of the display areas of the display panel 150. Also, the first to nth high-potential voltages are output in response to a scan signal, and these high-potential voltages vary for each subframe for the sake of luminance compensation.

While the foregoing description has been given separately of the second and third exemplary embodiments, the second and third exemplary embodiments can be combined together to solve the problem of luminance differences for each position on the display panel by means of the AWD driving scheme according to the present invention.

Fourth Exemplary Embodiment

Figure 17:
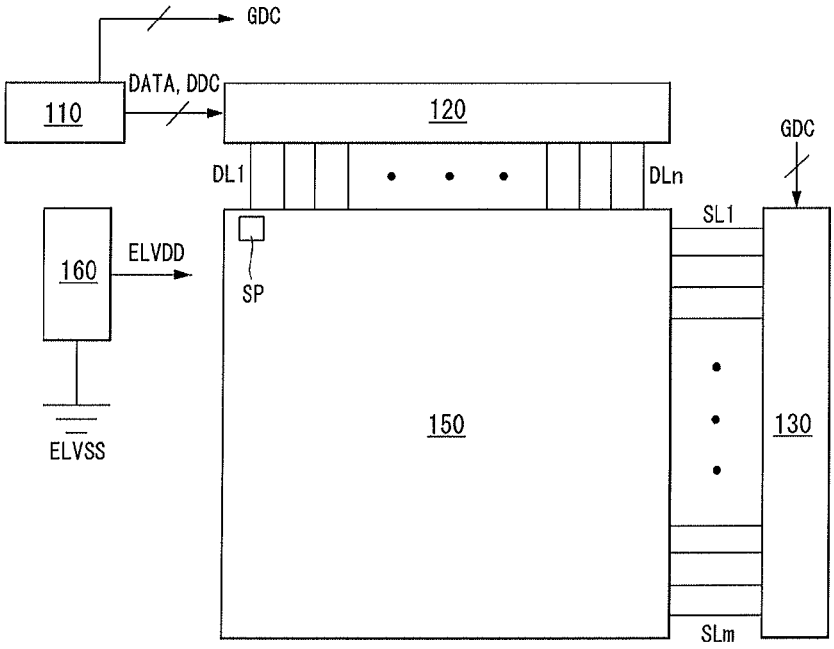
FIG. 17 is a schematic block diagram of an organic electroluminescence display according to a fourth exemplary embodiment.
Figure 18:
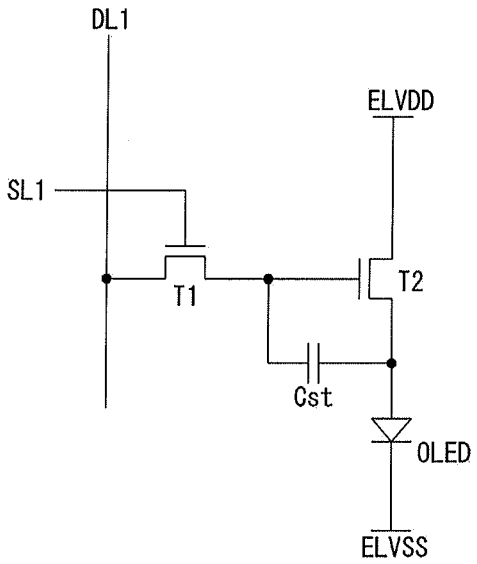
FIG. 18 is a circuit diagram of a subpixel according to the fourth exemplary embodiment.

FIG. 17 is a schematic block diagram of an organic electroluminescence display according to a fourth exemplary embodiment. FIG. 18 is a circuit diagram of a subpixel according to the fourth exemplary embodiment.

As shown in FIG. 17, the organic electroluminescence display according to the fourth exemplary embodiment comprises a timing controller 110, a data driver 120, a scan driver 130, a power supply 160, and a display panel 150.

As shown FIG. 18, a subpixel SP comprises a first transistor T1, a second transistor T2, a capacitor Cst, and an organic light emitting diode OLED.

The timing controller 110, the data driver 120, the scan driver 130, the power supply 160, the display panel 150, and the subpixel SP have been described in the first exemplary embodiment, so the descriptions of them will be omitted to avoid redundancy.

The organic electroluminescence display according to the fourth exemplary embodiment is implemented by an ADS driving scheme. In the AWD driving scheme, the organic light emitting diode emits light while performing an addressing operation to supply a data signal. In the following description, the conventional art and the fourth exemplary embodiment will be compared to help understanding of the present disclosure. For convenience of explanation, first to fourth subframes are shown, but this is only an example and n (N is a positive integer greater than 4) subframes may be provided.

Figure 19:
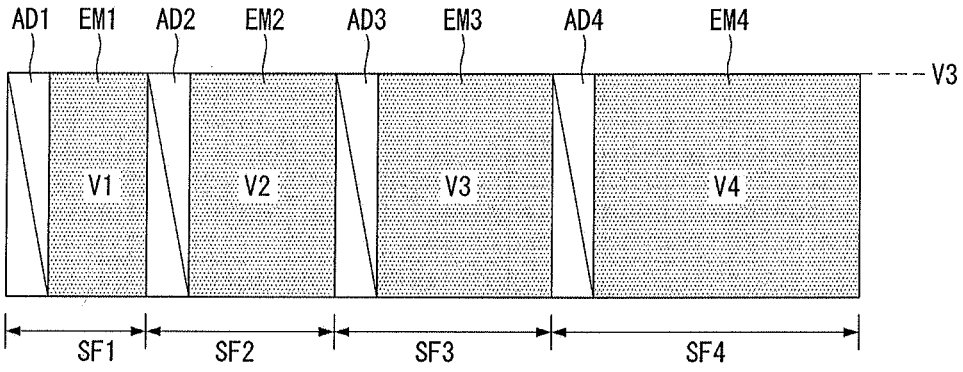
FIG. 19 is a view showing a conventional ADS digital driving scheme.
Figure 20:
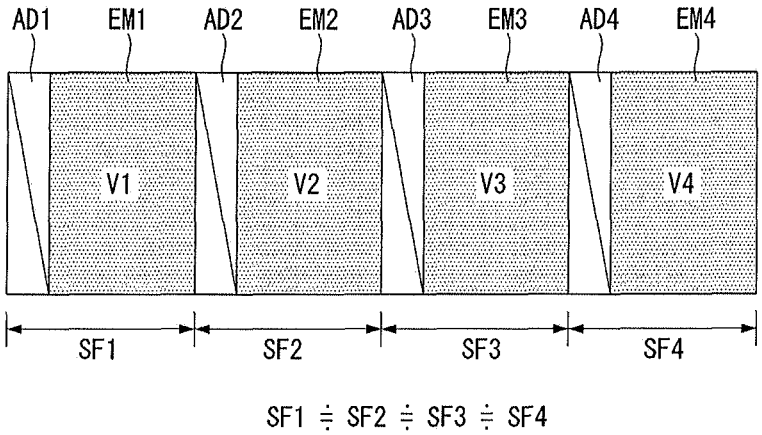
FIG. 20 is a view showing an ADS digital driving scheme according to the fourth exemplary embodiment.
Figure 21:
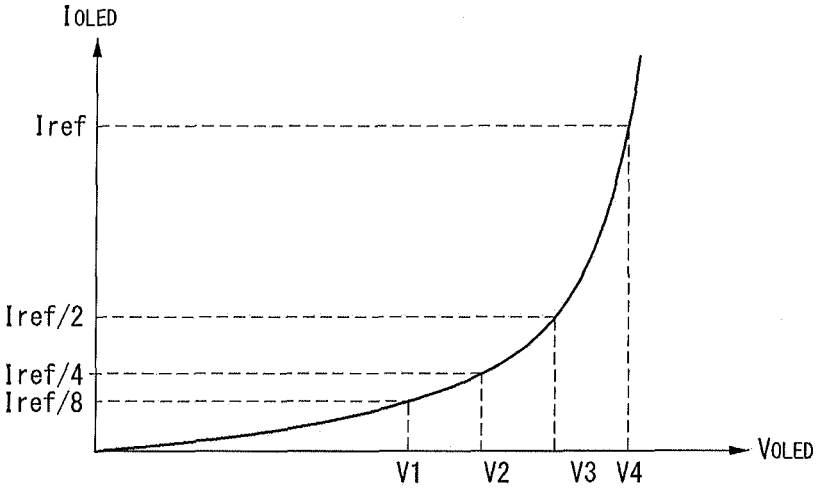
FIGS. 21 and 22 are views for explaining the concept of the ADS digital driving scheme according to the fourth exemplary embodiment.
Figure 22:
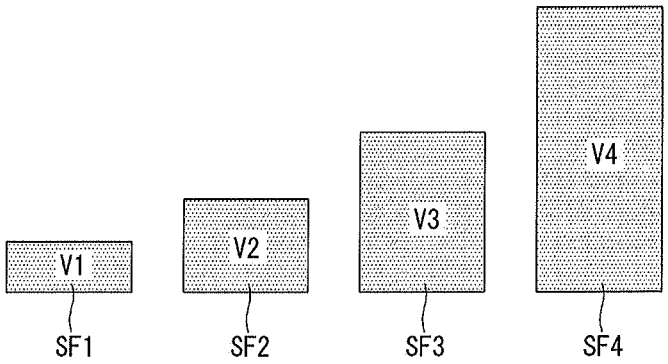

FIG. 19 is a view showing a conventional ADS digital driving scheme. FIG. 20 is a view showing an ADS digital driving scheme according to the fourth exemplary embodiment. FIGS. 21 and 22 are views for explaining the concept of the ADS digital driving scheme according to the fourth exemplary embodiment.

Conventional ADS Digital Driving Scheme

As shown in FIG. 20, the conventional ADS digital driving scheme comprises addressing periods AD1 to AD4 for supplying a data signal and light emission periods EM1 to EM4 for causing the organic light emitting diode to emit light.

In the conventional ADS digital driving scheme, the proportions of the light emission periods EM1 to EM4 of first to fourth subframes SF1 to SF4 are different. Specifically, the proportions of the light emission periods EM1 to EM4 of first to fourth subframes SF1 to SF4 are in the order of SF<SF2<SF3<SF4. The first to fourth subframes SF1 to SF4 show equal luminance. The conventional ADS digital driving scheme operates in this manner because gradation is determined by the proportions of the light emission periods of subframes.

In the conventional ADS digital driving scheme, subframes and addressing time are limited by the frame rate and resolution of a display device, and are under many time constraints because multiple frames are required to achieve sufficient color depth.

ADS Digital Driving Scheme According to Fourth Exemplary Embodiment

As shown in FIG. 20, the ADS digital driving scheme according to the fourth exemplary embodiment comprises addressing periods AD1 to AD4 for supplying a data signal and light emission periods EM1 to EM4 for causing the organic light emitting diode to emit light.

In the ADS digital driving scheme according to the fourth exemplary embodiment, the proportions of the light emission periods EM1 to EM4 of first to fourth subframes SF1 to SF4 are similar or equal. Specifically, the proportions of the light emission periods EM1 to EM4 of first to fourth subframes SF1 to SF4 are in the order of SF≈SF2≈SF3≈SF4. The first to fourth subframes SF1 to SF4 show different luminance.

In the ADS digital driving scheme according to the fourth exemplary embodiment, a high-potential voltage supplied to the subpixels of the display panel for each subframe is varied in order to reduce temporal load on subframes.

For example, in order to increase the light emission period of a subframe with a low gray level (or a low-order bit subframe), the amount of current to the subpixels can be reduced by lowering the high-potential voltage, or the amount of light emission can be decreased by adjusting the light emission period and non-light emission period (on/off) of the subpixels. Also, in order to decrease the light emission period of a subframe with a high gray level (or a high-order bit subframe), the amount of current flowing through the subpixels can be increased by raising the high-potential voltage, or the amount of light emission can be increased by adjusting the light emission period and non-light emission period (on/off) of the subpixels.

When driving the display panel based on horizontal resolution (H) x vertical resolution (V), frame rate F, and total number K of subframes, 1 horizontal period (t_1H)=1 horizontal row charging time=function of panel RC load 1 vertical period (t_1V)=total addressing time=V*t_1H 1/F=1 frame time=Σ(t_1V+t_SF_k) where t_SF_k=light emission period of kth subframe and k=1, 2, . . . , K.

Therefore, the time length of t_SF_k varies, the light emission period becomes shorter toward the LSB (least significant bit), and the error rate increases when a distortion occurs. The luminance detected during ADS digital driving is proportional to the time integral of the luminance per unit time, so that current and voltage are controlled to be in proportion to each other, as shown in FIG. 21, in order to equalize the light emission periods of subframes.

As depicted in the curve of current flowing through the organic light emitting diode versus voltage in FIG. 21, the high-potential voltage supplied to the subpixels has to vary for each subframe with reference to the voltage VOLED that determines the current IOLED proportional to luminance. For example, the high-potential voltage should vary from first to fourth voltages V1 to V4 to show the luminance corresponding to first to fourth currents Iref/8 to Iref. As the current IOLED is in the relationship: Iref/8<Iref/4<Iref/2<Iref, the voltage VOLED is in the relationship: V1<V2<V3<V4 as shown in FIG. 11.

In other words, the first subframe SF1 has the first voltage V1, the second subframe SF2 has the second voltage V2, the third subframe SF3 has the third voltage V3, and the fourth subframe SF4 has the fourth voltage V4. These voltages are in the relationship: V1<V2<V3<V4.

In the conventional ADS digital driving scheme, subframes and addressing time are limited by the frame rate and resolution of a display device, and are under many time constraints because multiple frames are required to achieve sufficient color depth.

Nevertheless, the problems occurring in the conventional art can be solved by making the proportions of the light emission periods EM1 to EM4 of first to fourth subframes SF1 to SF4 similar or equal and varying the high-potential voltage supplied to the subpixels for each subframe by the ADS digital driving scheme according to the fourth exemplary embodiment of the present invention.

According to the foregoing exemplary embodiments, the present invention allows for estimation of charging time (detection of load characteristics) by taking the load and device characteristics (e.g., RC delay) of the display panel into account, set the number of subframes and the light emission periods of the subframes equally or properly according to purpose, and handle and compensate for (compensate for and optimize) variations in the driving time of the subframes. In this case, luminance (current and voltage) can be increased for a shortened, high-order bit subframe or decreased for a lengthened, low-order bit subframe, or light emission time or non-light emission time (or light-off time) can be adjusted to set the corresponding luminance (current and voltage). If necessary, a data signal can be varied to correspond to adjusted luminance, or the light emission of a certain row or column can be controlled.

As seen from above, the present invention can achieve improvements in response speed and picture quality when realizing a large-area, high-resolution display panel by adjusting the light emission periods of subframes and varying a high-potential voltage as required.

What is claimed is:

1. An organic electroluminescence display that drives a display panel, the organic electroluminescence display comprising:

a data driver that supplies a bit value of a data signal to a subpixel in units of subframes to the display panel at different times for different scan lines depending on a scan signal; and a power supply that supplies a high-potential voltage to the subpixels of the display panel, wherein the high-potential voltage has different voltage levels for different subframes and luminance differences for the bit value within the same subframe with subpixel position on the display are compensated by varying the bit value for each subframe for each subpixel pixel position on the display panel power supply varies the high-potential voltage supplied to subpixels of the display panel for each subframe.

2. The organic electroluminescence display of claim 1, wherein the power supply lowers the high-potential voltage in order to increase the light emission period of a subframe and raises the high-potential voltage in order to decrease the light emission period.

3. The organic electroluminescence display of claim 1, wherein the data driver sets the light emission periods of the subframes to be approximately equal.

4. The organic electroluminescence display of claim 1, wherein the display panel comprises first to nth power lines that are separated horizontally or vertically with respect to the subpixels, and the power supply outputs first to nth high-potential voltages whose phase changes every M (M is an integer greater than 1) lines.

5. The organic electroluminescence display of claim 1, wherein the high-potential voltages are output at different times for different lines every M lines.

6. A driving method of an organic electroluminescence display that drives a display panel, the method comprising:

supplying a data signal in units of subframes to the display panel; and supplying a high-potential voltage to the display panel and varying the high-potential supplied to subpixles of the display panel for each subframe, wherein, in the supplying of the data signal, luminance differences within the same subframe are compensated for by varying the bit value of the subframe for each subpixel position on the display panel.

7. The method of claim 6, wherein, in the varying of the high-potential voltage, the high-potential voltage is lowered in order to increase the light emission period of a subframe and the high-potential voltage is raised in order to decrease the light emission period of a subframe.

8. The method of claim 6, wherein the light emission periods of the subframes are set to be approximately equal.

* * * * *